US010145047B2

(12) United States Patent
Suh et al.

(10) Patent No.: US 10,145,047 B2
(45) Date of Patent: Dec. 4, 2018

(54) CONTROL DEVICE FOR WASHING MACHINE AND METHOD THEREFOR

(71) Applicant: LG ELECTRONICS INC., Seoul (KR)

(72) Inventors: Mina Suh, Seoul (KR); Jayoen Kim, Seoul (KR); Joohyeon Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 176 days.

(21) Appl. No.: 15/121,165

(22) PCT Filed: Jul. 3, 2014

(86) PCT No.: PCT/KR2014/005962

§ 371 (c)(1),
(2) Date: Aug. 24, 2016

(87) PCT Pub. No.: WO2015/137569

PCT Pub. Date: Sep. 17, 2015

(65) Prior Publication Data

US 2017/0009390 A1 Jan. 12, 2017

(30) Foreign Application Priority Data

Mar. 10, 2014 (KR) ..... 10-2014-0027891

(51) Int. Cl.

| | |
|---|---|
| ***D06F 23/02*** | (2006.01) |
| ***D06F 33/00*** | (2006.01) |
| ***D06F 33/02*** | (2006.01) |
| ***D06F 39/00*** | (2006.01) |
| ***D06F 39/02*** | (2006.01) |

(Continued)

(52) U.S. Cl.

CPC ..... *D06F 33/00* (2013.01); *D06F 23/02* (2013.01); *D06F 39/003* (2013.01); *D06F 39/02* (2013.01); *D06F 39/045* (2013.01); *D06F 39/087* (2013.01); *D06F 33/02* (2013.01); *D06F 37/06* (2013.01); *D06F 37/14* (2013.01); *D06F 39/14* (2013.01); *D06F 2202/10* (2013.01); *D06F 2204/04* (2013.01); *D06F 2204/065* (2013.01);

(Continued)

(58) Field of Classification Search

CPC ..... D06F 23/02; D06F 33/00; D06F 33/02; D06F 39/003; D06F 39/02; D06F 39/045; D06F 39/087; D06F 2202/10

USPC ..... 8/158, 159; 68/12.03, 12.04, 12.05

See application file for complete search history.

(56) References Cited

U.S. PATENT DOCUMENTS

| | | | |
|---|---|---|---|
| 2008/0276964 | A1 | 11/2008 | Hendrickson et al. |
| 2010/0205823 | A1 | 8/2010 | Ashrafzadeh et al. |

FOREIGN PATENT DOCUMENTS

| | | | |
|---|---|---|---|
| CN | 1054625 | A | 9/1991 |
| CN | 102021787 | A | 4/2011 |

(Continued)

*Primary Examiner* — Levon J Shahinian

(74) *Attorney, Agent, or Firm* — Dentons US LLP

(57) ABSTRACT

The present disclosure relates to: a washing machine capable of washing laundry automatically by a washing method suitable for the laundry; and a control method therefore. A control device for a washing machine according to embodiments of the present invention may comprise: a fabric detection unit for detecting the fabric texture of laundry received in a drum of a washing machine; a detection unit for detecting the weight of the laundry; and a control unit for determining the fabric type of the laundry on the basis of the detected fabric texture, and controlling the washing machine on the basis of the fabric type and the weight of the laundry.

16 Claims, 6 Drawing Sheets

(51) Int. Cl.

| | |
|---|---|
| ***D06F 39/04*** | (2006.01) |
| ***D06F 39/08*** | (2006.01) |
| *D06F 39/14* | (2006.01) |
| *D06F 37/06* | (2006.01) |
| *D06F 37/14* | (2006.01) |

(52) U.S. Cl.
CPC ..... *D06F 2210/00* (2013.01); *D06F 2216/00* (2013.01)

(56) References Cited

FOREIGN PATENT DOCUMENTS

| | | | |
|---|---|---|---|
| CN | 102782203 | A | 11/2012 |
| CN | 103485121 | A | 1/2014 |
| CN | 103604937 | A | 2/2014 |
| JP | 2013-180161 | A | 9/2013 |
| KR | 10-1994-0024141 | A | 11/1994 |
| KR | 10-1998-0082406 | A | 12/1998 |
| KR | 10-2011-0027282 | A | 3/2011 |
| KR | 10-2013-0044764 | A | 5/2013 |
| WO | 2008000812 | A1 | 1/2008 |
| WO | 2011/109371 | A2 | 9/2011 |
| WO | 2013/011604 | A1 | 1/2013 |
| WO | 2013080089 | A2 | 6/2013 |

CONTROL DEVICE FOR WASHING MACHINE AND METHOD THEREFOR

This application is a National Stage Entry of International Application No. PCT/KR2014/005962, filed Jul. 3, 2014, which claims the benefit of Korean International Application No. 10-2014-0027891, filed Mar. 10, 2014, both of which are hereby incorporated by reference in their entirety for all purposes as if fully set forth herein.

TECHNICAL FIELD

The present disclosure relates to a control device for a washing machine and a method for controlling the same.

BACKGROUND ART

In general, a washing machine is a machine for washing laundry and the like, and includes a drum which is rotatable in a main body thereof. Things to be washed, such as the laundry and the like, are received in the drum and then washed by rotation of the drum and a pulsator provided in the drum.

As one example of the washing machine, a drum type washing machine includes a cabinet forming an accommodation space therein, a tub provided in the cabinet and storing washing water therein, a drum rotatably disposed in the tub, and a driving motor rotating the drum.

DISCLOSURE OF THE INVENTION

An aspect of the detailed description is to provide a washing machine, capable of automatically washing laundry by a washing method suitable for the laundry, in a manner of deciding a type (e.g., cotton fabrics, hemp fabrics, woolen fabrics, silk fabrics, blend fabrics, union fabrics, etc.) of fabric texture (textile as a material of cloth) of the laundry such as clothes or the like received in a drum of the washing machine, and washing the laundry based on the decided fabric type, and a method for controlling the same.

To achieve these and other advantages in accordance with the purpose of the present invention, as embodied and broadly described herein, there is provided a control device for a washing machine, the device including a fabric detection unit for detecting the fabric texture of laundry received in a drum of a washing machine, a detection unit for detecting the weight of the laundry, and a control unit for determining the fabric type of the laundry on the basis of the detected fabric texture, and controlling the washing machine on the basis of the fabric type and the weight of the laundry In accordance with embodiments of the present invention, the fabric detection unit may be drawn out of a wash stick within the drum for a preset time to detect the fabric texture of the laundry, and then inserted back into the wash stick after a lapse of the preset time.

In accordance with embodiments of the present invention, the fabric detection unit may be drawn out of an inner surface of the drum for a preset time to detect the fabric texture of the laundry, and then inserted back into the inner surface of the drum after a lapse of the preset time.

In accordance with embodiments of the present invention, the fabric detection unit may be drawn out of a lift which lifts and drops the laundry, in response to a rotation of the drum, for a preset time to detect the fabric texture of the laundry, and then inserted back into the lift after a lapse of the preset time.

In accordance with embodiments of the present invention, the fabric detection unit may be drawn out of a door opening and closing an introduction opening of the drum for a preset time to detect the fabric texture of the laundry, and then inserted back into the door after a lapse of the preset time.

In accordance with embodiments of the present invention, the fabric detection unit may detect a frictional resistance value due to a contact with the laundry, and output the detected frictional resistance value as the fabric texture of the laundry.

In accordance with embodiments of the present invention, the control unit may select the same or similar value to the detected frictional resistance value among predecided frictional resistance values corresponding to the fabric texture of each fabric type, and control temperature of the laundry to be applied into the drum, a washing level of the laundry and a dehydrating speed of the laundry on the basis of the fabric type corresponding to the selected frictional resistance value and the detected weight.

In accordance with embodiments of the present invention, the control unit may output the decided fabric type on a display unit.

In accordance with embodiments of the present invention, the control unit may receive frictional resistance values of the laundry detected in real time by the fabric detection unit while an operation of detecting the weight of the laundry is performed, calculate an average value of the received frictional resistance values, select the same or similar value to the average value from the predecided frictional resistance values, and control a temperature of the laundry to be applied into the drum, a washing level of the laundry and a dehydrating speed of the laundry on the basis of the selected frictional resistance value and the detected weight.

In accordance with embodiments of the present invention, the fabric detection unit may include a camera for capturing the fabric of the laundry within the drum, and a light source for emitting light to the laundry when capturing the fabric of the laundry. The control unit may compare the captured fabric image with prestored fabric images. When the same or similar fabric image to the captured fabric image is included in the prestored fabric images according to the comparison result, the control unit may decide a fabric type corresponding to the included fabric image as the fabric type of the current laundry within the drum.

In accordance with embodiments of the present invention, the fabric detection unit may redetect the fabric texture of the laundry after completely washing the laundry. The control unit may compare the detected fabric texture with the redetected fabric texture, generate information notifying a washed state of the laundry based on the comparison result, and output the generated information on a display unit.

In accordance with embodiments of the present invention, the control unit may generate first information notifying a good washed state of the laundry when the detected fabric texture and the redetected fabric texture are the same as or similar to each other. The control unit may generate second information notifying a bad washed state of the laundry when the detected fabric texture and the redetected fabric texture are different from each other.

In accordance with embodiments of the present invention, the control unit may transmit a washing method of the laundry corresponding to the first information to a server, such that the washing method of the laundry corresponding to the first information is transmitted to a plurality of washing machines connected together through a communication network.

In accordance with embodiments of the present invention, the control unit may generate information advising to avoid a washing method of the laundry corresponding to the second information, and transmit the generated information to the server.

In accordance with embodiments of the present invention, the control unit may transmit the washing method of the laundry corresponding to the first information to the server such that the washing method of the laundry corresponding to the first information is transmitted to a plurality of washing machines connected together through a communication network, when the first information is accumulated by a reference number of times or more.

In accordance with embodiments of the present invention, the control unit may generate information advising to avoid a washing method of the laundry corresponding to the second information when the second information is accumulated by a reference number of times or more, and output the generated information on the display unit or transmits the generated information to the server.

In accordance with embodiments of the present invention, the fabric detection unit may detect the fabric texture of the laundry while an operation of detecting the weight of the laundry is performed, detect the fabric texture of the laundry while the laundry is washed by supplying washing water in the drum, or detect the fabric texture of the laundry while the laundry is washed by applying washing water and detergent in the drum.

To achieve these and other advantages in accordance with the purpose of the present invention, as embodied and broadly described herein, there is provided a method for controlling a washing machine, the method including detecting fabric texture of laundry accommodated in a drum of the washing machine, detecting a weight of the laundry, deciding a fabric type of the laundry on the basis of the detected fabric texture, and washing the laundry on the basis of the fabric type and the weight of the laundry.

ADVANTAGEOUS EFFECT

In a washing machine and a method for controlling the same according to exemplary the embodiments of the present invention, laundry such as clothes and the like accommodated in a drum of the washing machine can automatically be washed by a washing method suitable for the laundry, by deciding a type (e.g., cotton fabrics, hemp fabrics, woolen fabrics, silk fabrics, blend fabrics, union fabrics, etc.) of fabric texture (or textile) of the laundry, and washing the laundry on the basis of the decided fabric type.

MODES FOR CARRYING OUT THE PREFERRED EMBODIMENTS

Description will now be given in detail according to exemplary embodiments disclosed herein, with reference to the accompanying drawings. For the sake of brief description with reference to the drawings, the same or equivalent components may be provided with the same or similar reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be connected with the other element or intervening elements may also be present. In contrast, when an element is referred to as being "directly connected with" another element, there are no intervening elements present.

A singular representation may include a plural representation unless it represents a definitely different meaning from the context.

Terms such as "include" or "has" are used herein and should be understood that they are intended to indicate an existence of several components, functions or steps, disclosed in the specification, and it is also understood that greater or fewer components, functions, or steps may likewise be utilized.

Hereinafter, description will be given of a washing machine, capable of automatically washing laundry by a washing method suitable for the laundry, in a manner of deciding a fabric type (e.g., cotton fabrics, hemp fabrics, woolen fabrics, silk fabrics, blend fabrics, union fabrics, etc.) (textile as a material of cloth) of the laundry such as clothes or the like received in a drum of the washing machine, and washing the laundry based on the decided fabric type, and a method for controlling the same.

Figure 1:
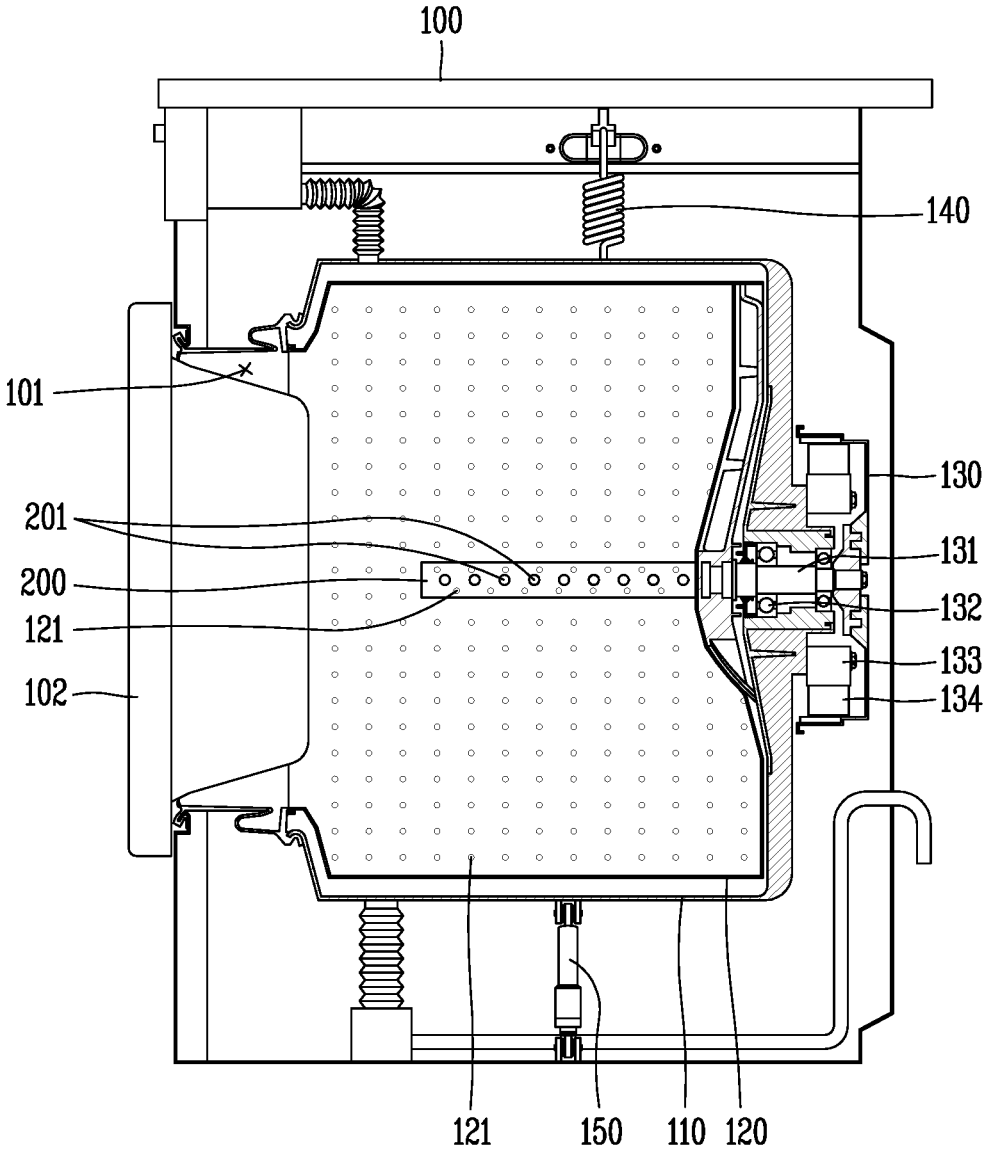
FIG. 1 is a lateral sectional view of a washing machine in accordance with an embodiment of the present invention.

FIG. 1 is a lateral sectional view of a washing machine in accordance with an embodiment of the present invention.

As illustrated in FIG. 1, a washing machine may include a cabinet 100 forming appearance and having an accommodation space therein, a tub 110 disposed within the cabinet 100, a drum 120 rotatably disposed in the tub 110, and a driving motor 130 rotating the drum 120.

An opening (through hole) 101 through which laundry is thrown in and taken away and a door 102 for opening and closing the opening 101 are provided on a front surface of the cabinet 100.

A plurality of springs 140 which are extendable and contractible are connected between the tub 110 and the cabinet 100. FIG. 1 illustrates only one spring 140, but it is merely illustrative. The spring 140 may be provided in plurality.

A plurality of dampers 150 which reduce vibration of the tub 110 may be disposed in the tub 110. FIG. 1 illustrates only one damper 150, but it is merely illustrative. The damper 150 may be provided in plurality.

The drum 120 is a cylindrical body which is rotatably disposed in the tub 110, and accommodates laundry therein. A plurality of drain holes 121 are open through an outer circumference of the drum 120. Accordingly, the laundry is turned with being sunk in washing water stored in the tub 110.

The driving motor 130 supplies a driving force for rotating the drum 120. The driving motor 130 includes a rotation shaft 131 coupled to the drum 120 to transfer a rotation force of the driving motor 130 to the drum 120, and a bearing 132 rotatably supporting the rotation shaft 131. Here, the driving motor 130 is provided with a stator 133 and a rotor 134, and the rotation shaft 131 is connected to the rotor 134.

A wash stick 200 may be installed on a center of the drum 120. The wash stick 200 may be rotated in response to the rotation of the drum 120. A fabric detection unit 201 for detecting fabric texture of laundry is installed within the wash stick 200. The fabric detection unit 201 may be provided by one or in plurality within the wash stick 200. The wash stick 200 may be provided with a plurality of openings. The fabric detection unit 201 may be drawn from inside to outside of the wash stick 200 for a preset time (e.g., 1 minute) to detect a fabric texture (textile texture) of the laundry within the drum 120, and thereafter introduced into the wash stick 200 after the preset time (e.g., 1 minute). The operation of drawing out or inserting the fabric detection unit 201 (i.e., an operation that a sensor is drawn out and then inserted) can be designed by already-known plural technologies, so detailed description thereof will be omitted.

The washing machine may further include a temperature sensor detecting washing temperature of the laundry, a heater increasing washing temperature of the laundry, a humidity sensor and the like.

Figure 2:
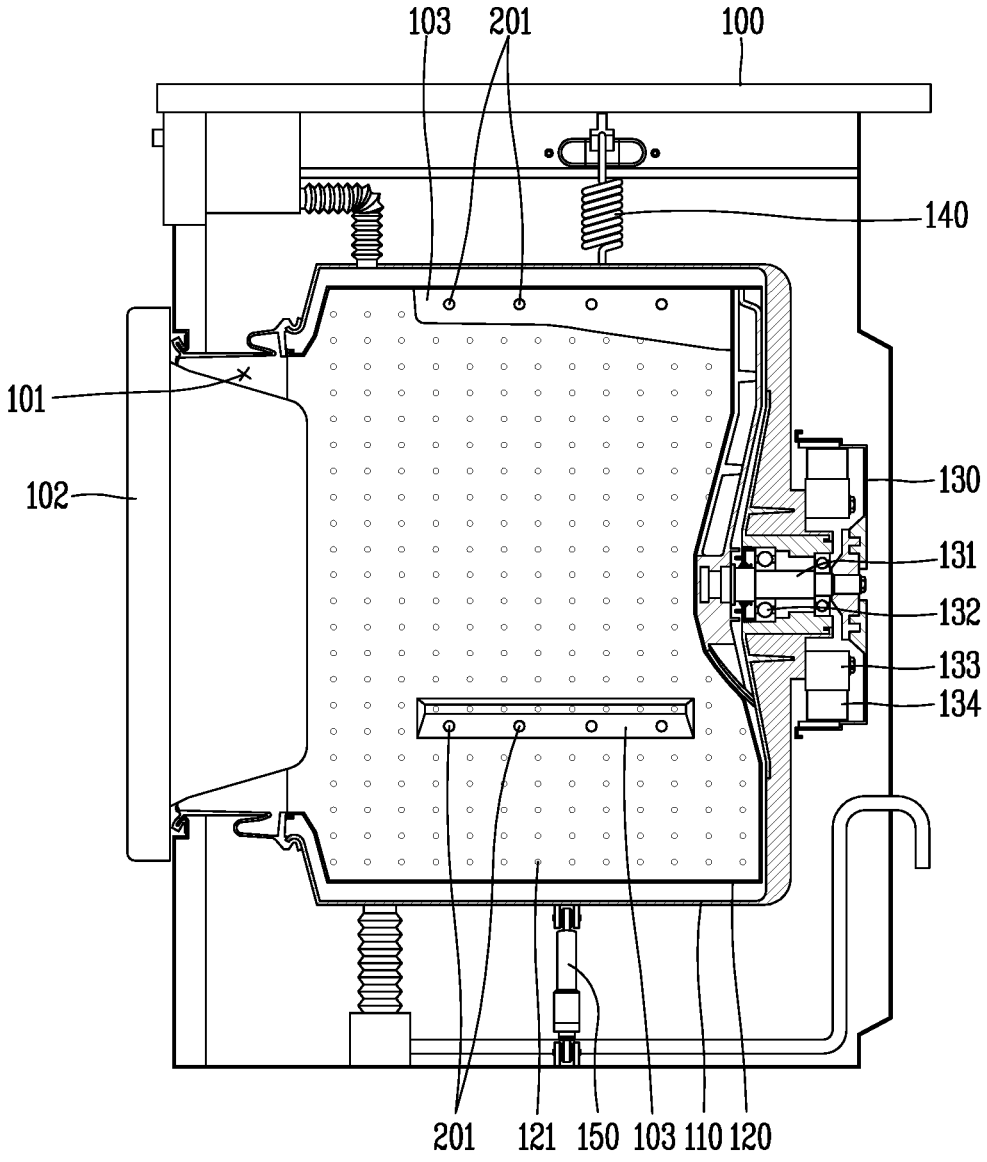
FIG. 2 is a lateral sectional view of a washing machine in accordance with another embodiment of the present invention.

FIG. 2 is a lateral sectional view of a washing machine in accordance with another embodiment of the present invention.

As illustrated in FIG. 2, a plurality of lifts 103 which lift laundry and drop them in response to the rotation of the drum 120 may be provided on an inner surface of the drum 120. The fabric detection unit 201 may be provided in plurality on side surfaces of the plurality of lifts 103.

The fabric detection unit 201 may be drawn out of the lift 103 for a preset time (e.g., 1 minute) to detect the fabric texture of the laundry within the drum 120 and then inserted into the lift 103 after the preset time (e.g., 1 minute). The fabric detection unit 201 may alternatively be provided in plurality on an inner surface of the drum 120.

Figure 3A:
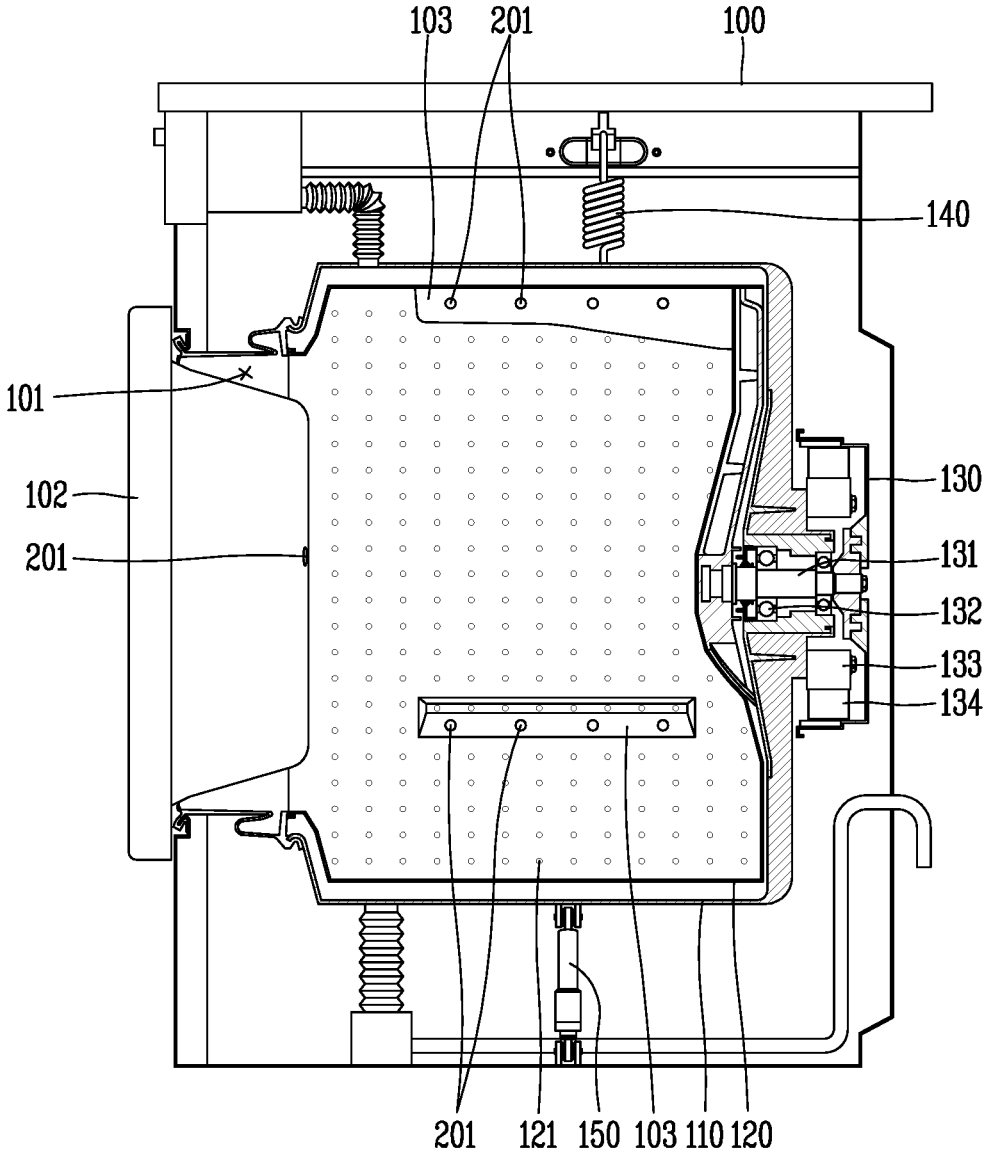
FIGS. 3A and 3B are views of a washing machine in accordance with another embodiment of the present invention.
Figure 3B:
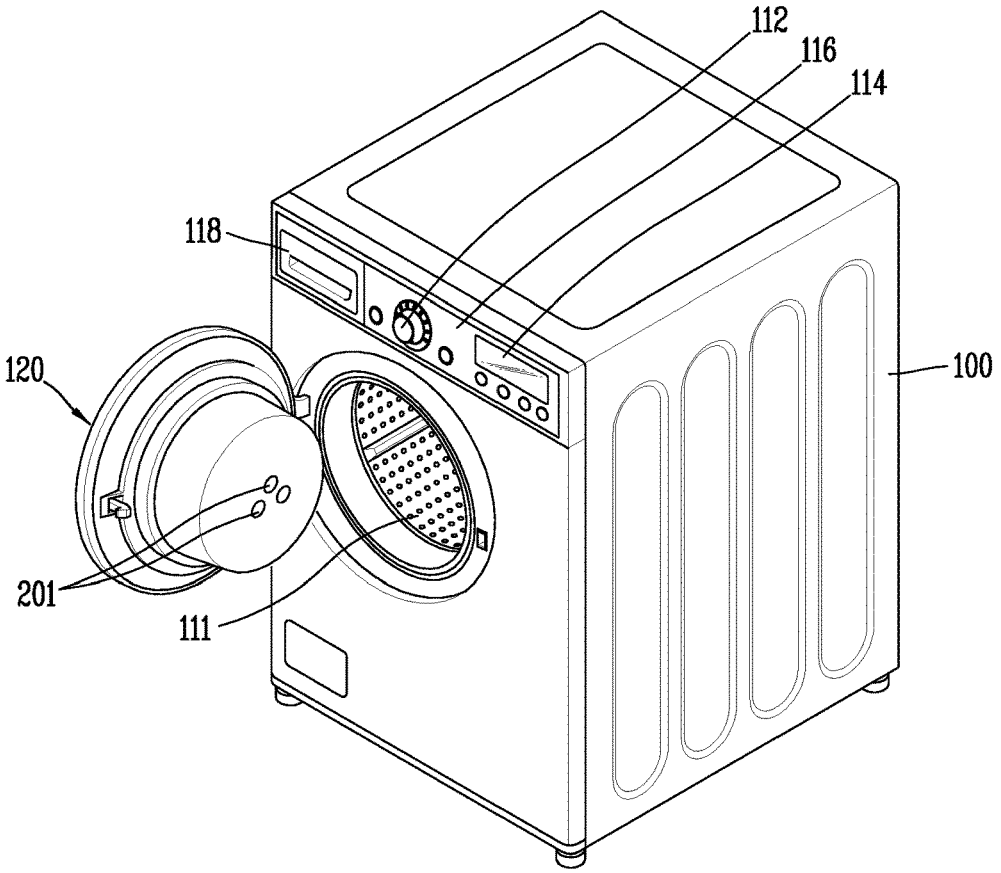

FIGS. 3A and 3B are views of a washing machine in accordance with another embodiment of the present invention.

As illustrated in FIGS. 3A and 3B, the fabric detection unit 201 may further be installed on a door 120 which opens and closes a laundry introduction opening 111 formed on a front surface of the cabinet 100. Also, the fabric detection unit 201 may alternatively be installed only on the door 120 which opens and closes the laundry introduction opening 111 formed on the front surface of the cabinet 100.

Various manipulation members 112 for manipulating the washing machine, and a control panel 116 with a display 114 for notifying an operating state of the washing machine to a user are provided on an upper portion of the front surface of the cabinet 100. Also, a detergent supply device 118 in which detergent to be used during a washing operation is stored is provided in the upper portion of the front surface of the cabinet 100.

The fabric detection unit 201 may be drawn out of an inside of the door 120 toward an inside of the drum 120 for a preset time (e.g., 1 minute) to detect fabric texture of the laundry within the drum 120. After the preset time (e.g., 1 minute), the fabric detection unit 201 may be inserted back into the door 120. The fabric detection unit 201 may alternatively be provided in plurality in the door 120.

As described above, the fabric detection unit 201 can be installed in any portion if it can be brought into contact with the laundry within the drum 120.

Figure 4:
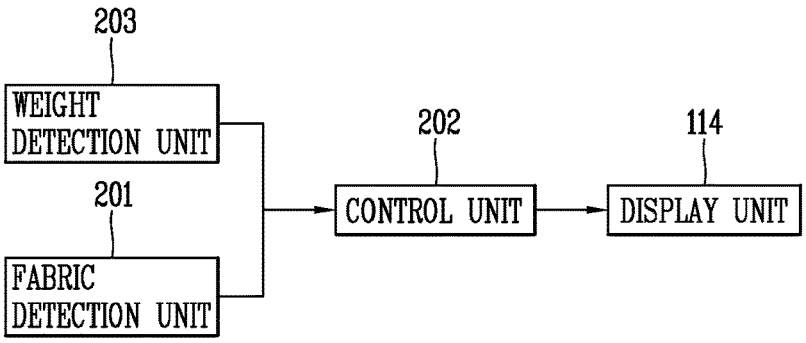
FIG. 4 is a view illustrating a control device for a washing machine in accordance with an embodiment of the present invention.

FIG. 4 is a view illustrating a control device for a washing machine in accordance with an embodiment of the present invention.

As illustrated in FIG. 4, a control device for a washing machine according to an embodiment of the present invention includes a fabric detection unit 201 for detecting fabric texture of laundry accommodated within the drum 120 of the washing machine, a weight detection unit 203 for detecting a weight (or amount) of the laundry accommodated within the drum of the washing machine, and a control unit 202 for deciding a fabric type of the laundry on the basis of the fabric texture of the laundry and controlling the washing machine on the basis of the decided fabric type and the detected weight of the laundry.

Figure 5:
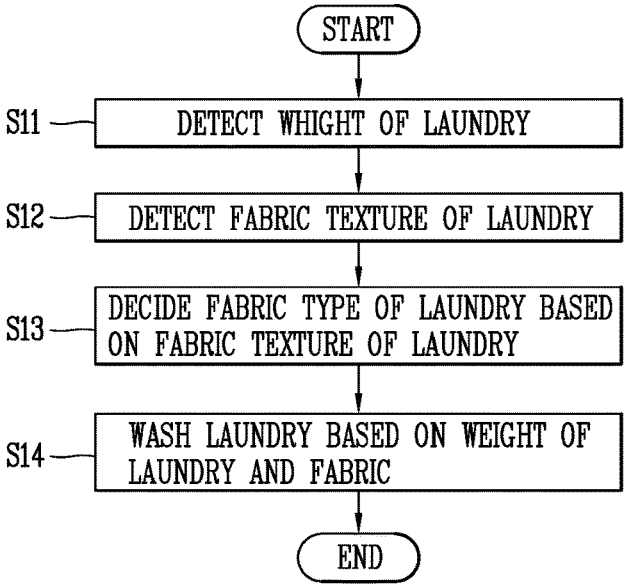
FIG. 5 is a flowchart illustrating a method for controlling a washing machine in accordance with an embodiment of the present invention.

FIG. 5 is a flowchart illustrating a method for controlling a washing machine in accordance with an embodiment of the present invention.

First, the weight detection unit 203 detects a weight (amount) of laundry accommodated in the drum of the washing machine, and outputs a weight value (or an amount value) corresponding to the detected weight to the control unit 202 (S11). The weight detection unit 203 detecting the weight of the laundry accommodated in the drum of the washing machine is already known, so detailed description thereof will be omitted.

The control device for the washing machine according to the embodiment of the present invention may further include a display unit 114 for outputting a type (e.g., cotton fabrics, hemp fabrics, woolen fabrics, silk fabrics, blend fabrics, union fabrics, etc.) of fabric corresponding to the fabric texture of the laundry, and outputting the weight of the laundry.

The fabric detection unit 201 is drawn out of at least one of the wash stick 200, the lift 103, the drum 120 or the door 120 for a preset time (e.g., 1 minute) to detect the fabric texture of the laundry within the drum 120, and then inserted back into the at least one of the wash stick 200, the lift 103, the drum 120 or the door 120 after the preset time (e.g., 1 minute) (S12). For example, the fabric detection unit 201 may be a sensor which detects a frictional resistance value due to a contact with the laundry, and outputs the detected frictional resistance value as the fabric texture of the laundry.

The control unit 202 decides the fabric type of the laundry on the basis of the detected fabric texture (S13), and washes the laundry on the basis of the detected fabric type and the weight value of the laundry (S14). For example, the control unit 202 pre-stores predecided frictional resistance values corresponding to fabric textures of plural laundry, selects the same or similar value to the detected frictional resistance value among the predecided frictional resistance values, and controls temperature of the laundry to be applied into the drum, a washing level of the laundry, a dehydrating speed of the laundry and the like on the basis of the selected frictional resistance value and the detected weight. The predecided frictional resistance values corresponding to the fabric textures of the plural laundry may be stored in a storage unit (not illustrated).

The control unit 202 controls cotton fabrics, hemp fabrics, woolen fabrics, silk fabrics, blend fabrics, union fabrics, etc. to be independently accommodated within the drum 120 of the washing machine, pre-detects the frictional resistance value according to each fabric texture through the fabric detection unit 201, and pre-stores the pre-detected frictional resistance values in the storage unit. That is, the control unit 202 may recognize by the fabric detection unit 201 whether the fabric currently accommodated in the drum 120 is cotton fabric, hemp fabric, woolen fabric, silk fabric, blend fabric, or union fabric. The frictional resistance value of each fabric may differ according to a fabric type, and the fabric type of the laundry may be decided based on the frictional resistance value.

The control unit 202 may control the display unit 114 to output information notifying that the current laundry corresponds to the cotton fabrics when the currently-detected frictional resistance value through the fabric detection unit 201 is the same as or similar to the frictional resistance value corresponding to the cotton fabric.

The control unit 202 may control the display unit 114 to output information notifying that the current laundry corresponds to the hemp fabrics when the currently-detected frictional resistance value through the fabric detection unit 201 is the same as or similar to the frictional resistance value corresponding to the hemp fabric.

The control unit 202 may control the display unit 114 to output information notifying that the current laundry corresponds to the woolen fabrics when the currently-detected frictional resistance value through the fabric detection unit 201 is the same as or similar to the frictional resistance value corresponding to the woolen fabric.

The control unit 202 may control the display unit 114 to output information notifying that the current laundry corresponds to the silk fabrics when the currently-detected frictional resistance value through the fabric detection unit 201 is the same as or similar to the frictional resistance value corresponding to the silk fabric.

The control unit 202 may control the display unit 114 to output information notifying that the current laundry corresponds to the blend fabrics when the currently-detected frictional resistance value through the fabric detection unit 201 is the same as or similar to the frictional resistance value corresponding to the blend fabric.

The control unit 202 may control the display unit 114 to output information notifying that the current laundry corresponds to the union fabrics when the currently-detected frictional resistance value through the fabric detection unit 201 is the same as or similar to the frictional resistance value corresponding to the union fabric.

The fabric detection unit 201 may detect the fabric texture (frictional resistance value) of the laundry in real time while the operation of detecting the weight of the laundry within the drum 120 is performed, or detect the fabric texture of the laundry in real time while repetitively rotating the drum 120 to left and right for the preset time (e.g., 1 minute). That is, the drum 120 is driven (rotated) such that the fabric detection unit 201 is exposed to friction against the laundry.

Also, the control unit 202 calculates an average value of the real-time detected frictional resistance values (fabric textures) of the laundry for the preset time (e.g., 1 minute) while the operation of detecting the weight of the laundry within the drum 120 is performed. The control unit 202 may then select the same or similar value to the calculated average value from the pre-determined frictional resistance values, and control a washing temperature (e.g., 25° to 60°) of the laundry to be applied into the drum, the washing level of the laundry (e.g., strong, medium, weak), and a dehydrating speed of the laundry (e.g., strong, medium, weak) on the basis of the selected frictional resistance value and the detected weight. The washing temperature, the washing level, the dehydrating speed and the like according to the fabric type may be reset by a designer or a user.

The control unit 202 may also decide the fabric type of the laundry on the basis of the fabric texture detected by the fabric detection unit 201 after washing water is supplied into the drum 120 or before washing water is supplied into the drum 120.

The fabric detection unit 201 may also include a camera (not illustrated) for capturing the fabric texture of the laundry within the drum 120, and a light source (e.g., a light emitting diode (LED), a lamp, etc.) for emitting light to the laundry when capturing the fabric texture of the laundry. In this instance, the control unit 202 may compare a captured fabric image with prestored fabric images. When a fabric image which is the same as or similar to the captured fabric image (e.g., fabric pattern) is present among the prestored fabric images according to the comparison result, the control unit 202 may alternatively decide a fabric type corresponding to the present fabric image as the fabric type of the laundry currently accommodated in the drum 120. In this instance, the control unit 202 may decide the fabric type of the laundry currently accommodated in the drum 120 even in a state that the rotation of the drum 120 is stopped.

The control unit 202 may also decide the fabric type of the current laundry on the basis of the frictional resistance value currently detected through the fabric detection unit 201 and the captured fabric image. For example, when a fabric type corresponding to the currently-detected frictional resistance value matches the fabric type decided based on the captured fabric image, the control unit 202 may also decide the matched fabric type as the fabric type of the current laundry. On the other hand, when the fabric type corresponding to the currently-detected frictional resistance value does not match the fabric type decided based on the captured fabric image, the control unit 202 may control the display unit 114 to output information for requesting the user to select a fabric type of the current laundry, and decide the fabric type selected by the user as the fabric type of the current laundry.

The fabric detection unit 201 may be configured as one of a tactile sensor, a sliding angle sensor and the like, or by combination thereof, to detect the fabric texture of the laundry. The tactile sensor may be a fibratus tactile sensor which senses a delicate touch by applying thin flexible fibers.

The control unit 202 may also decide the fabric type of the laundry on the basis of the fabric texture detected by the fabric detection unit 201 after a detergent is supplied into the drum 120 or before the detergent is supplied into the drum 120.

Figure 6:
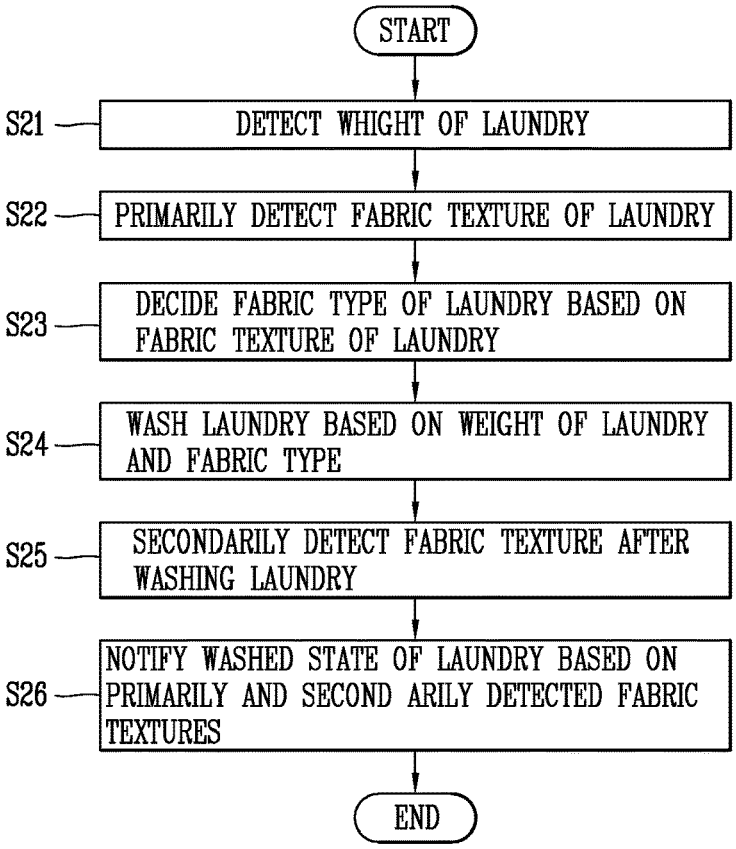
FIG. 6 is a flowchart illustrating a method for controlling a washing machine in accordance with another embodiment of the present invention.

FIG. 6 is a flowchart illustrating a method for controlling a washing machine in accordance with another embodiment of the present invention.

First, the weight detection unit 203 detects a weight (or amount) of the laundry accommodated in the drum 120 of the washing machine, and outputs a weight value (or amount value) corresponding to the detected weight (or amount) to the control unit 202 (S21).

The fabric detection unit 201 primarily detects the fabric texture (e.g., primary frictional resistance value) of the laundry within the drum 120 for a preset time (e.g., 1 minute) (S22). For example, the fabric detection unit 201 may be a sensor that detects a frictional resistance value due to a contact with the laundry, and outputs the detected frictional resistance value as the fabric texture of the laundry.

The control unit 202 decides the fabric type of the laundry on the basis of the detected fabric texture (S23), and washes the laundry on the basis of the detected fabric type and the weight value (or amount value) of the laundry (S24). For example, the control unit 202 pre-stores predecided frictional resistance values corresponding to fabric textures of plural laundry, selects the same or similar value to the detected frictional resistance value among the predecided frictional resistance values, and controls temperature of the laundry to be applied into the drum, a washing level of the laundry, a dehydrating speed of the laundry and the like on the basis of the selected frictional resistance value and the detected weight.

The control unit 202 secondarily detects the fabric texture (e.g., secondary frictional resistance value) of the laundry in order to detect states before and after washing the laundry, when the laundry is completely washed (S25).

The control unit 202 notifies the user of the washed state of the laundry on the basis of the primary fabric texture (e.g., primary frictional resistance value) and the secondary fabric texture (e.g., secondary frictional resistance value) of the laundry (S26).

For example, the control unit 202 compares the primary fabric texture (e.g., primary frictional resistance value) and the secondary fabric texture (e.g., secondary frictional resistance value) of the laundry. When the primary fabric texture (e.g., primary frictional resistance value) and the secondary fabric texture (e.g., secondary frictional resistance value) of the laundry are the same as or similar to each other according to the comparison result, the control unit 202 generates information notifying a good washed state of the laundry and output the generated information on the display unit 114. On the other hand, the control unit 202 compares the primary fabric texture (e.g., primary frictional resistance value) and the secondary fabric texture (e.g., secondary frictional resistance value) of the laundry. When the primary fabric texture (e.g., primary frictional resistance value) and the secondary fabric texture (e.g., secondary frictional resistance value) of the laundry are different from each other according to the comparison result, the control unit 202 generates information notifying a bad washed state of the laundry and outputs the generated information on the display unit 114.

Figure 7:
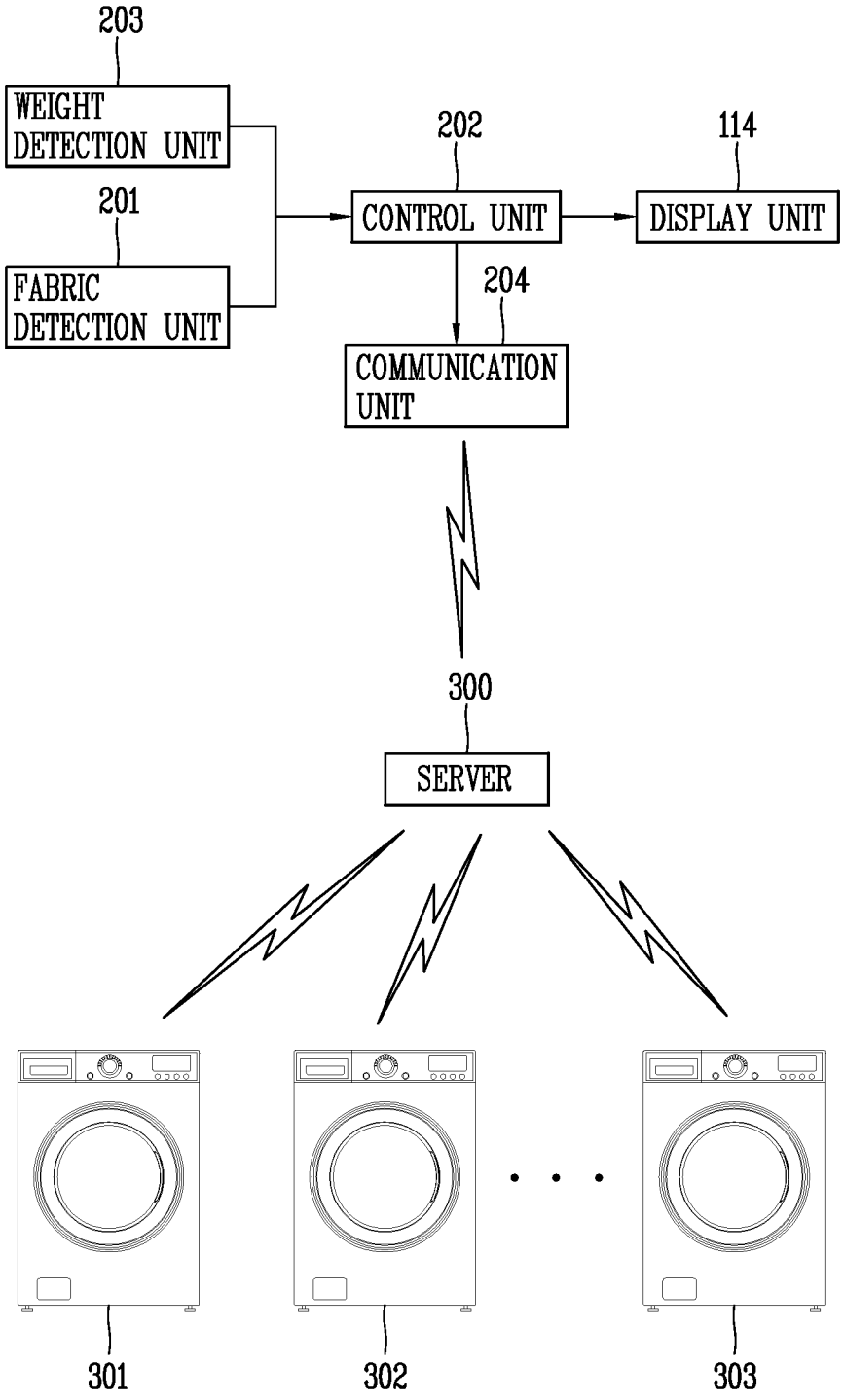
FIG. 7 is a view illustrating a control device for a washing machine in accordance with another embodiment of the present invention.

FIG. 7 is a view illustrating a control device for a washing machine in accordance with another embodiment of the present invention.

First, the weight detection unit 203 detects a weight (or amount) of the laundry accommodated in the drum 120 of the washing machine, and outputs a weight value (or amount value) corresponding to the detected weight (or amount) to the control unit 202.

The fabric detection unit 201 primarily detects the fabric texture (e.g., primary frictional resistance value) of the laundry within the drum 120 for a preset time (e.g., 1 minute). For example, the fabric detection unit 201 may be a sensor that detects a frictional resistance value due to a contact with the laundry, and outputs the detected frictional resistance value as the fabric texture of the laundry.

The control unit 202 decides the fabric type of the laundry on the basis of the detected fabric texture, and washes the laundry on the basis of the detected fabric type and the weight value (or amount value) of the laundry. For example, the control unit 202 pre-stores predecided frictional resistance values corresponding to fabric textures of plural laundry, selects the same or similar value to the detected frictional resistance value among the predecided frictional resistance values, and controls temperature of the laundry to be applied into the drum, a washing level of the laundry, a dehydrating speed of the laundry and the like on the basis of the selected frictional resistance value and the detected weight.

The control unit 202 secondarily detects the fabric texture (e.g., secondary frictional resistance value) of the laundry in order to detect states before and after washing the laundry, when the laundry is completely washed.

The control unit 202 compares the primary fabric texture (e.g., primary frictional resistance value) and the secondary fabric texture (e.g., secondary frictional resistance value) of the laundry. When the primary fabric texture (e.g., primary frictional resistance value) and the secondary fabric texture (e.g., secondary frictional resistance value) of the laundry are the same as or similar to each other according to the comparison result, the control unit 202 generates information notifying a good washed state of the laundry and outputs the generated information on the display unit 114.

The control unit 202 compares the primary fabric texture (e.g., primary frictional resistance value) and the secondary fabric texture (e.g., secondary frictional resistance value) of the laundry. When the primary fabric texture (e.g., primary frictional resistance value) and the secondary fabric texture (e.g., secondary frictional resistance value) of the laundry are different from each other according to the comparison result, the control unit 202 generates information notifying a bad washed state of the laundry and outputs the generated information on the display unit 114.

The control unit 202 may also transmit the generated information to a server 300 through a communication unit 204. For example, the control unit 202 transmits to the server 300 first information notifying the good washed state of the laundry and second information notifying the bad washed state of the laundry. When the first information is received by a reference number of times (e.g., 5 to 10 times) or more, the server 300 may set a washing method (washing temperature, washing level, dehydrating speed, etc.) of the laundry corresponding to the first information in a plurality of other washing machines 301 to 303 connected to the server 300.

On the other hand, when the second information is received by a reference number of times (e.g., 5 to 10 times) or more, the server 300 may generate information advising to avoid a washing method (washing temperature, washing level, dehydrating speed, etc.) of the laundry corresponding to the second information, and transmit the generated information to the plurality of other washing machines 301 to 303 connected to the server 300.

The control unit 202 may also transmit the washing method (washing temperature, washing level, dehydrating speed, etc.) of the laundry corresponding to the first information to the server 300 when the first information is accumulated by a reference number of times (e.g., 5 to 10 times) or more.

The control unit 202 may also generate information advising to avoid the washing method (washing temperature, washing level, dehydrating speed, etc.) of the laundry corresponding to the second information when the second information is accumulated by a reference number of times (e.g., 5 to 10 times) or more, and transmit the generated information to the server 300.

As described above, in a washing machine and a control method thereof according to embodiments of the present invention, laundry such as clothes and the like accommodated in a drum of the washing machine can automatically be washed by a washing method suitable for the laundry, by deciding a type (e.g., cotton fabrics, hemp fabrics, woolen fabrics, silk fabrics, blend fabrics, union fabrics, etc.) of fabric texture (or textile) of the laundry, and washing the laundry on the basis of the decided fabric type.

The present invention can be implemented as computer-readable codes in a program-recorded medium. The computer-readable medium may include all types of recording devices each storing data readable by a computer system. Examples of such computer-readable media may include ROM, RAM, CD-ROM, magnetic tape, floppy disk, optical data storage element and the like. Also, the computer-readable medium may also be implemented as a format of carrier wave (e.g., transmission via an Internet).

The configurations and methods of the mobile terminal in the aforesaid embodiments may not be limitedly applied, but such embodiments may be configured by a selective combination of all or part of each embodiment so as to derive many variations.

The invention claimed is:

1. A control device for a washing machine, the device comprising:

a fabric detection unit configured to detect a fabric texture of laundry received in a drum of a washing machine;

a detection unit configured to detect a weight of the laundry; and a control unit configured to determine a fabric type of the laundry based on the detected fabric texture, and configured to control the washing machine based on the fabric type and the weight of the laundry, wherein the fabric detection unit detects a frictional resistance value due to contact with the laundry, and outputs the detected frictional resistance value as the fabric texture of the laundry, and wherein the control unit selects a same or similar value to the detected frictional resistance value among predecided frictional resistance values corresponding to the fabric texture of each fabric type, and controls a temperature of the laundry to be applied into the drum, a washing level of the laundry, and a dehydrating speed of the laundry based on the fabric type corresponding to the selected frictional resistance value and the detected weight.

2. The device of claim 1, wherein the fabric detection unit is drawn out of a wash stick within the drum for a preset time to detect the fabric texture of the laundry, and then inserted back into the wash stick after a lapse of the preset time.

3. The device of claim 1, wherein the fabric detection unit is drawn out of an inner surface of the drum for a preset time to detect the fabric texture of the laundry, and then inserted back into the inner surface of the drum after a lapse of the preset time.

4. The device of claim 1, wherein the fabric detection unit is drawn out of a lift which lifts and drops the laundry, in response to a rotation of the drum, for a preset time to detect the fabric texture of the laundry, and then inserted back into the lift after a lapse of the preset time.

5. The device of claim 1, wherein the fabric detection unit is drawn out of a door opening and closing an introduction opening of the drum for a preset time to detect the fabric texture of the laundry, and then inserted back into the door after a lapse of the preset time.

6. The device of claim 1, wherein the control unit outputs a decided fabric type on a display unit.

7. The device of claim 1, wherein the control unit receives frictional resistance values of the laundry detected in real time by the fabric detection unit while an operation of detecting the weight of the laundry is performed, calculates an average value of the received frictional resistance values, selects the same or similar value to the average value from a predecided frictional resistance values, and controls a temperature of the laundry to be applied into the drum, a washing level of the laundry, and a dehydrating speed of the laundry based on the selected frictional resistance value and the detected weight.

8. The device of claim 1, wherein the fabric detection unit comprises:

a camera configure to capture an image of the fabric of the laundry within the drum; and a light source configured to emit light to the laundry when capturing the fabric of the laundry, wherein the control unit compares a captured fabric image with prestored fabric images, and, when a same or similar fabric image to the captured fabric image is included in the prestored fabric images according to a comparison result, decides a fabric type corresponding to an included fabric image as the fabric type of a current laundry within the drum.

9. The device of claim 1, wherein the fabric detection unit redetects the fabric texture of the laundry after completely washing the laundry, and wherein the control unit compares the detected fabric texture with the redetected fabric texture, generates information notifying a washed state of the laundry based on a comparison result, and outputs the generated information on a display unit.

10. The device of claim 9, wherein the control unit generates first information notifying a good washed state of the laundry when the detected fabric texture and the redetected fabric texture are the same as or similar to each other, and wherein the control unit generates second information notifying a bad washed state of the laundry when the detected fabric texture and the redetected fabric texture are different from each other.

11. The device of claim 10, wherein the control unit transmits a washing method of the laundry corresponding to the first information to a server, such that the washing method of the laundry corresponding to the first information is transmitted to a plurality of washing machines connected together through a communication network.

12. The device of claim 11, wherein the control unit generates information advising to avoid a washing method of the laundry corresponding to the second information, and transmits the generated information to the server.

13. The device of claim 11, wherein the control unit generates information advising to avoid a washing method of the laundry corresponding to the second information when the second information is accumulated by a reference number of times or more, and outputs the generated information on the display unit or transmits the generated information to the server.

14. The device of claim 10, wherein the control unit transmits the washing method of the laundry corresponding to the first information to the server such that the washing method of the laundry corresponding to the first information is transmitted to a plurality of washing machines connected together through a communication network, when the first information is accumulated by a reference number of times or more.

15. The device of claim 1, wherein the fabric detection unit detects the fabric texture of the laundry while an operation of detecting the weight of the laundry is performed, detects the fabric texture of the laundry while the laundry is washed by supplying washing water in the drum, or detects the fabric texture of the laundry while the laundry is washed by applying washing water and detergent in the drum.

16. A method for controlling a washing machine, the method comprising:

detecting fabric texture of laundry accommodated in a drum of the washing machine;

detecting a weight of the laundry;

deciding a fabric type of the laundry based on the detected fabric texture; and washing the laundry based on the fabric type and the weight of the laundry, wherein the detecting the fabric texture comprises detecting a frictional resistance value due to contact with the laundry, and outputting the detected frictional resistance value as the fabric texture of the laundry, and wherein the washing the laundry comprises:

selecting a same or similar value to the detected frictional resistance value among predecided frictional resistance values corresponding to the fabric texture of each fabric type; and controlling a temperature of the laundry to be applied into the drum, a washing level of the laundry, and a dehydrating speed of the laundry based on the fabric type corresponding to the selected frictional resistance value and the detected weight.

* * * * *